US005469975A

United States Patent [19]

Fajnsztajn

[11] Patent Number: 5,469,975

[45] Date of Patent: Nov. 28, 1995

[54] MOUNT FOR USE WITH A POSTAL SORTING TRAY

[76] Inventor: Aleksander Fajnsztajn, P.O. Box 6684, San Fafael, Calif. 94903

[21] Appl. No.: 173,202

[22] Filed: Dec. 27, 1993

[51] Int. Cl.[6] ..... A47F 5/00

[52] U.S. Cl. ..... 211/10; 211/184; 40/641; 40/658

[58] Field of Search ..... 211/184, 10, 11, 211/86, 90; 40/642, 649, 651, 658, 661, 600, 641, 818

[56] References Cited

U.S. PATENT DOCUMENTS

| | | | |
|---|---|---|---|
| 1,216,250 | 2/1917 | Bittle | 211/10 X |
| 1,343,423 | 6/1920 | Todd | 211/10 X |
| 2,800,732 | 7/1957 | Duran | 40/658 |
| 3,070,234 | 12/1962 | Deitchman | 211/10 |
| 3,269,788 | 8/1966 | Kneer | 211/10 X |
| 3,438,143 | 4/1969 | Wolfersberger | 40/641 |
| 3,507,063 | 4/1970 | Jochheim | 40/641 |
| 3,780,876 | 12/1973 | Elkins | 211/184 |
| 5,056,248 | 10/1991 | Blanchard | 40/661 X |

*Primary Examiner*—Robert W. Gibson, Jr.
*Attorney, Agent, or Firm*—Harold D. Messner

[57] ABSTRACT

In accordance with the present invention, the L-shaped status bar is modified by the addition of a mount to form a status bar subassembly. In the subassembly, the mount is preferably slidably attached to the status bar by an inverted U-shaped clasp, such U-shaped clasp being open along one side to slidably attach about a vertically extending leg of the L-shaped status bar. Positioned above the U-shaped clasp is a upright U-shaped, indicia supporting frame. The frame includes a pair of side walls and an end wall. The frame is open along one side and attaches to the U-shaped clasp at an opposite common end wall. The cavity formed between the side and end walls of the frame is constructed to receive a card that contains written indicia wherein all data related to an addressee's (or addressees') change in status per slot. In that way, efficiency of service is greatly improved.

9 Claims, 4 Drawing Sheets

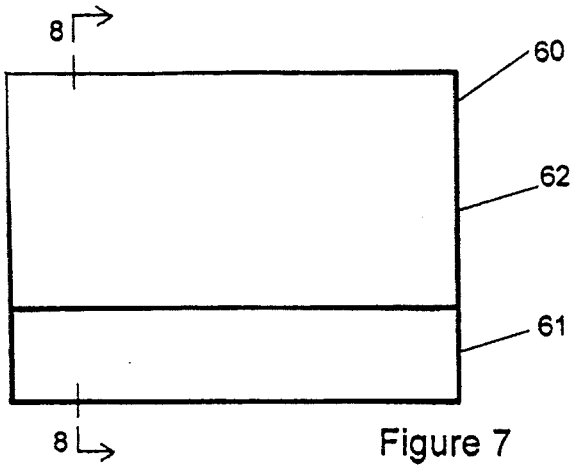
Figure 7
Figure 8
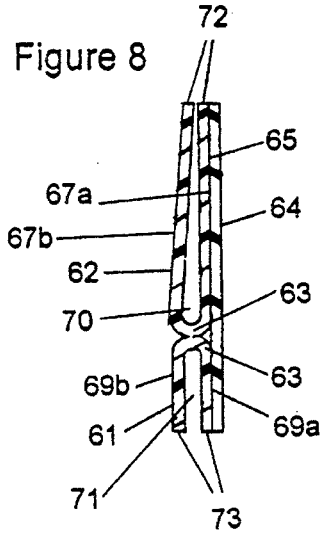
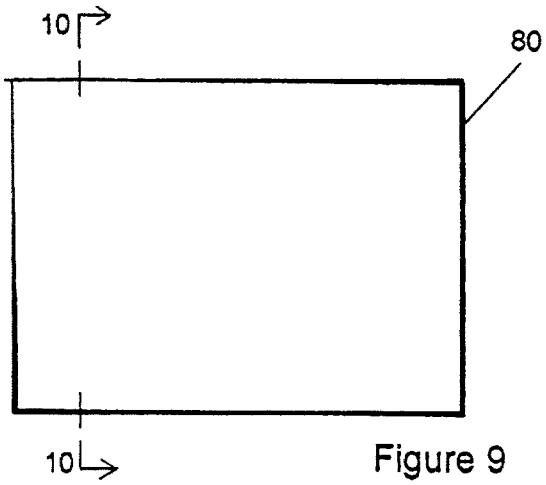
Figure 9
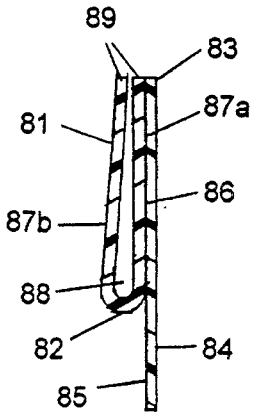
Figure 10
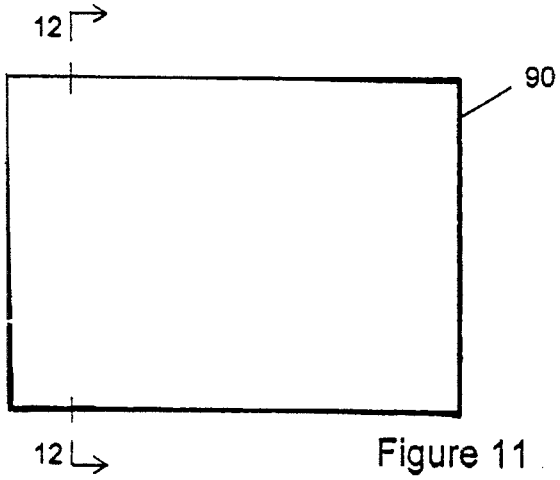
Figure 11
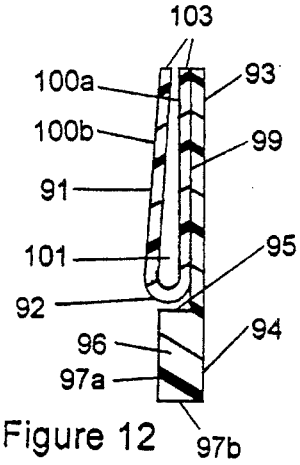
Figure 12

MOUNT FOR USE WITH A POSTAL SORTING TRAY

SCOPE OF THE INVENTION

This invention related to a postal sorting tray for sorting mail of a selected size and shape and more particularly to a mount for use in association with a status bar to form a status bar subassembly that fits horizontally within a given slot for a series of slots formed within the tray, such tray being normalized to a given geographical area or street region, such slot being associated with a given address within such geographical area or street region, and finally such subassembly being for the purpose of aiding the sorter in identifying different addressees even though the latter can be associated with the same address slot in the tray or bin.

BACKGROUND OF THE INVENTION

Sorting of mail of a selected size and shape uses a tray or bin having a series of elongated slots arranged in columns and rows. The floor of the bin is supported on a horizontal base such as a table. The bin is also organized so a given number of slots is associated with a given geographical area or street region and each slot is associated with a given address within such geographical or street region.

Changes in mail associated with a given slot is indicated by a status bar inserted within a give elongated slot, such bar being color coded to given situation: yellow for recent forward, red for hold mail, blue for post office box and green for vacancy. Each bar is L-shaped in cross section and fits entirely with a given slot.

In operations, the sorter places the mail in the slots in rapid manner guided by the whether or not a status bar has been inserted within the slot. If no bar resides within the slot, the mail is correctly sorted. If a bar exists, the mail is routed to its proper designation. A problem exists where different addresses are associated with the same address, however. The regular carrier is often familiar with the status of a given slot, even though there may be multiple addressees per slot.

A problem often occurs where a substitute carrier is associated with a route. Such carrier is not familiar with such multiple addressees when looking at a specific color bar and moreover, he often does not derive any guide—information-wise—from the status bar. As a result, the substitute sorter often transfers the contents of a given slot to his route tray or bag even though he has not accounted for multiple addressees per slot and then re transfers such mis-sorted mail back to the central work station when the addressees discover the problem mail in the field.

SUMMARY OF THE INVENTION

In accordance with the present invention, the L-shaped status bar is modified by the addition of a mount to form a status bar subassembly. In the subassembly, the mount is preferably slidably attached to the status bar by an inverted U-shaped clasp, such U-shaped clasp being open along one side to slidably attach about a vertically extending leg of the L-shaped status bar.

Positioned above the U-shaped clasp is a upright U-shaped, indicia supporting frame. The frame includes a pair of side walls and an end wall. The frame is open along one side and attaches to the U-shaped clasp at an opposite common end wall. The cavity formed between the side and end walls of the frame is constructed to receive a card that contains written indicia wherein all data related to an addressee's (or addressees') change in status per slot. In that way, efficiency of service is greatly improved.

DESCRIPTION OF DRAWINGS

FIG. 7 is a front view of alternate mount of the invention;

FIG. 8 is a section taken along line 8—8 of FIG. 7;

FIG. 9 is a front view of another alternate mount of the invention;

FIG. 10 is a section taken along line 10—10 of FIG. 9;

FIG. 11 is a front view of still another alternate mount of the invention;

FIG. 12 is a section taken along line 12—12 of FIG. 11;

DESCRIPTION OF EMBODIMENTS OF THE INVENTION

Figure 1:
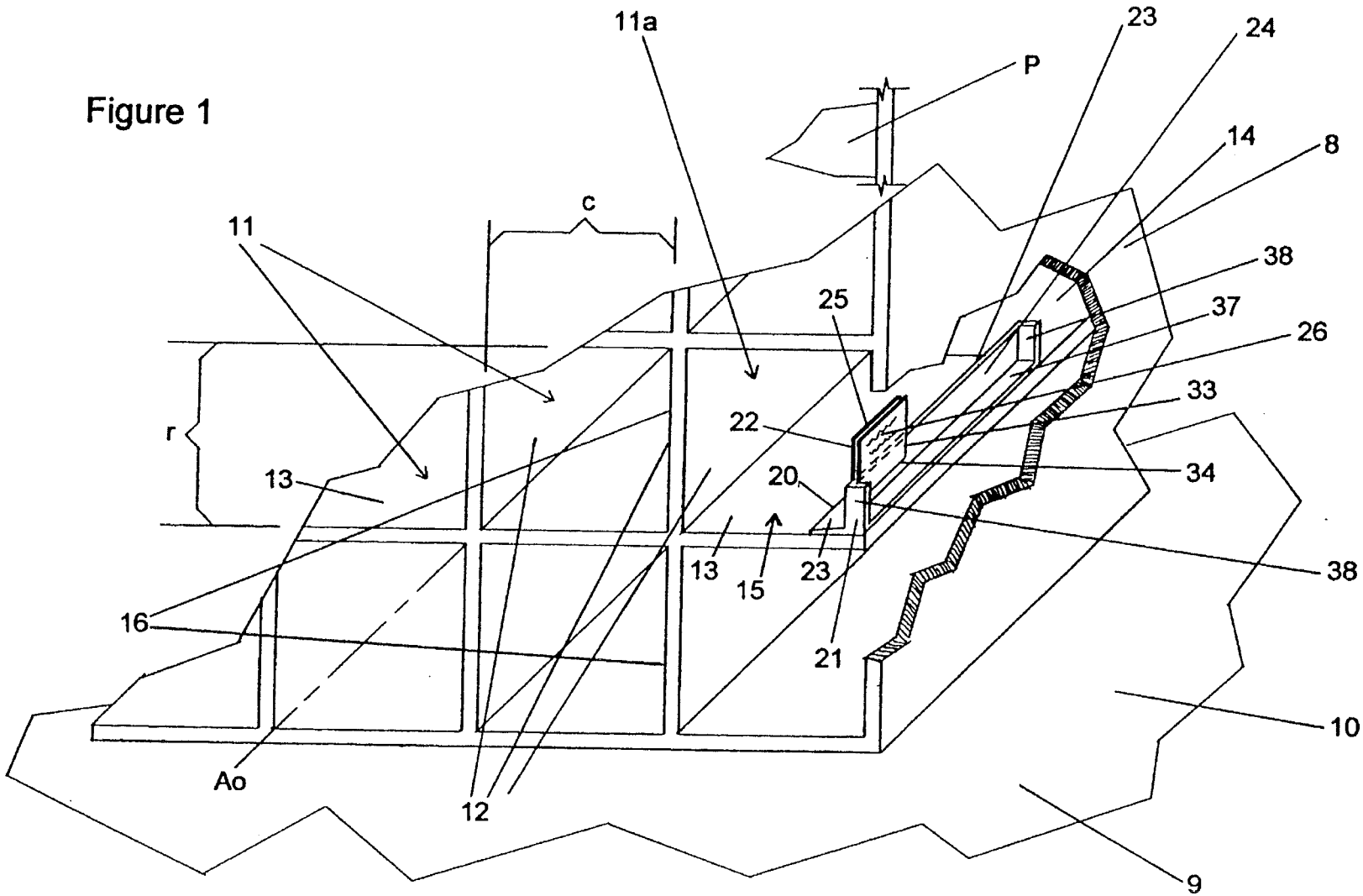
FIG. 1 is a perspective view of a storage bin showing a status bar extending over a vertical slot, such status bar including the mount of the invention.

A mail sorting tray or bin 10 is shown in FIG. 1. The tray 8 is supported on horizontal surface 9 of a table 10, and includes a series of slots 11 large enough to accommodate mail of a selected size and shape, each slot 11 defines a longitudinal axis of symmetry Ao parallel with side walls 12 and floor 13 and intersects end wall 14 at a right angle. The axis of symmetry Ao is also parallel to the horizontal surface 9 of the table 10.

Note that cavity 15 formed by side and end walls 12, 14 and floor 13 of each slot 11, is open at the end opposite to the end wall 14 to define a vertical opening 16. In that way, the openings 16 of the slots 11 define a common vertical plane P normal to the surface 9 of the table 10. The table 10 and tray 8 are thus constructed to permit easy sorting of the mail into the slots 11. That is to say, since the slots 11 are constructed to define a series of columns (c) and of rows (r) (where c is about 6 and r is about 40), there is amble numbers of slots 11 available so that each tray 10 can be organized in association with a given geographical area of street and region and each slot 11 can be organized to be associated with a given address within that geographical area or street region.

When changes in status of mail associated with a given slot occur, a status bar subassembly 20 is inserted within a give elongated slot, say slot 11*a*. Such status bar subassembly 20 includes a status bar 21 of L-shaped cross section inserted to one side through the opening 16 of the slot 11*a*, say in contact with floor 13, end wall 14 and one of the side walls 12 of the slot 11. Note that the length of the status bar 21 of the subassembly 20 is about equal to the depth of the cavity 15. Each subassembly 20 also includes a mount 22. Such mount 22, as explained below, is attached to end 23 of a vertical or transversely extending leg 24 of the bar 21 for the purpose for capturing a card 25 on which written indicia 26 is presented to guide the sorter is proper disposition of the mail for the addressee whose name appears as the indicia 26.

Note that the status bar subassembly 20 is one of a series of such status bar subassemblies inserted in various slots 11 of the tray 8. The purpose of the subassemblies 20: to indicate changes in status of the mail associated with the slot into the subassembly 20 individually resides. For example, the color of the L-shaped bar 21 can be used to indicate a change in status as follows: yellow for recent forward, red for hold mail, blue for post office box and green for vacancy.

FIG. 1 also indicates further information can be timely presented to the sorter via the mount 22, such mount 22 being attached about vertically tranversely extending leg 24 of the bar 21 for positioning a card 25 adjacent to the opening 16 of cavity 15 associated with a given slot 11*a*. The purpose of card 25 as previously indicated: to provide written indicia 26 to guide the sorter as to the proper disposition of the mail for the addressee whose name appears as the indicia 26.

Figure 2:
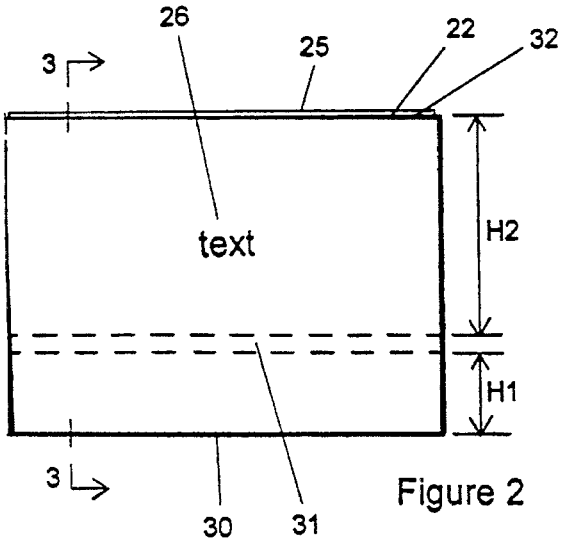
FIG. 2 is a front view of the mount of FIG. 1.
Figure 3:
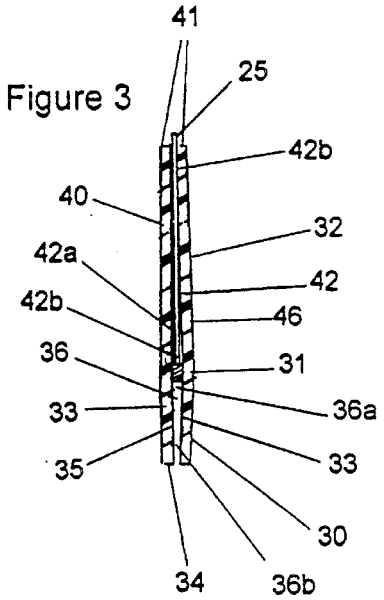
FIG. 3 is a section taken along line 3—3 of FIG. 2.
Figure 4:
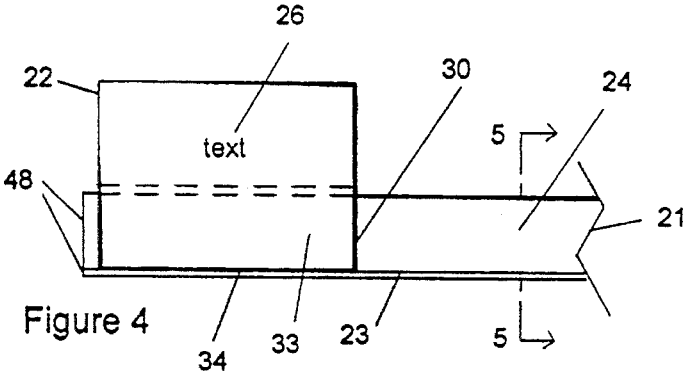
FIG. 4 is a front view of the status bar and mount of FIG. 1.

FIGS. 2, 3 and 4 show the mount 22 in more detail.

The mount 22 includes a clasp 30 of inverted U-shaped cross section connected by a common end wall 31 to upright frame 32 of upright U-shaped cross section.

The clasp 30 includes side walls 33 have terminal ends 34 opposite to common end wall 31 so that inner surfaces 35 adjacent to the ends 34 touch. In other words, the side walls 33 are constructed so that they are biased inwardly toward tear-drop shaped cavity 36. The cavity 36 is seen to include a bulbous portion 36*a* adjacent to the common end wall 31 and a declining apex 36*b* remote from the common end wall 31. Note that the declining apex 36*b* is constructed to be outwardly biasable to permit entry therethrough for the purpose of releasable attachment about vertical extending leg 24 of the bar 21, see FIG. 1. Moreover, the side walls 33 are constructed to define a height H1 measured from common end wall 31 to terminal ends 34 of such side walls 33. In that way, side walls 33 can be attached as shown in FIG. 1, i.e., attached about vertical extending leg 24 of the bar 21 wherein the terminal ends 34 of the side walls 33 are in broad contact with both (i) horizontal leg 23 of the bar 21 (on one side of the leg 24) and (ii) horizontal leg extension 37 of the horizontal leg 23 (on the other side of the leg 24) for the purpose of rigidly supporting and securing mount 22 relative to the status bar 21.

Upright frame 32 includes side walls 40 extending from common end wall 31 in a direction opposite to the clasp 30. The side walls 40 are coextensive of each other and terminate at ends 41. A tear-drop shaped cavity 42 is defined by the side walls 40 and common end wall 31. Not that the side walls 40 are constructed so that they are biased inwardly toward the tear-drop shaped cavity 42. The cavity 42 includes a bulbous portion 42*a* adjacent to the common end wall 31 and a declining apex 42*b* remote from the common end wall 31. Note that the declining apex 42*b* is constructed to be outwardly biasable to permit entry therethrough for the purpose of releasable attachment of a card 25 on which is carried written indicia 26 for the purpose of guiding the sorter in the disposition of mail associated with a given addressee. Moreover, the side walls 40 are constructed to define a height H2 measured from common end wall 31 to terminal edges 48 of such side walls 40 wherein H2> H1. In that way, the card 25 on which written indicia 26 is presented to guide the sorter is proper disposition of the mail, can be releasably retained between the side walls 40 within the tear-droped shaped cavity 42.

Figure 6:
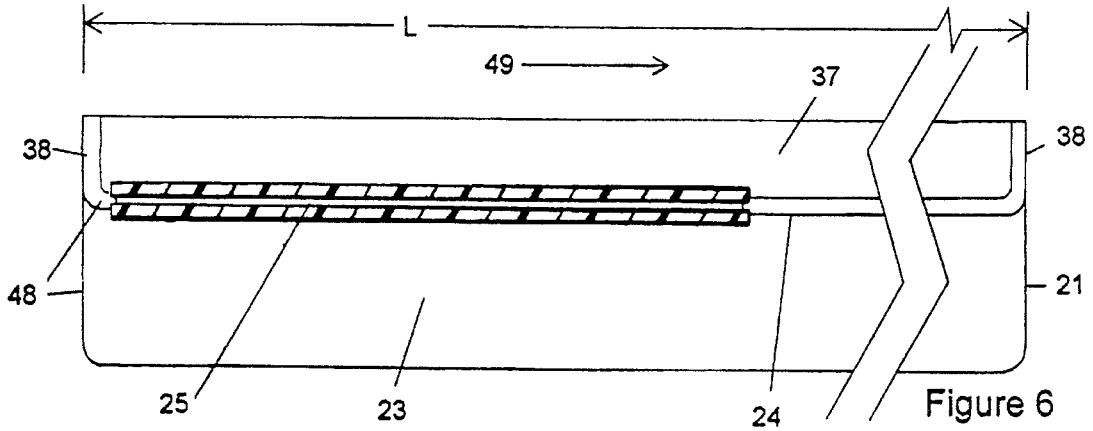
FIG. 6 is a top view of the status bar and mount of FIG. 4.

FIGS. 4 and 6 show the position of the mount 22 relative to the status bar 21. As shown, the mount 22 is located along the length L of the status bar 21 at any convenient location, say adjacent to coplaner ends 48 of the horizontal and upright legs 23, 24 of the status bar 21 but is capable of being moved to other locations along the bar in the direction of arrow 49 toward the centroid of the status bar 2l so as to permit the sorter's fingers to safety penetrate about the mount 22 including card 25 with indicia 26, without mishap. That is to say, the tension between the side walls 33 of the clasp 30 of the mount 22 and the upright leg 24 of the status bar 21, can be released by application of a force parallel to arrow 49. As previously mentioned, the terminal edges 34 of the clasp 31 are seen to be in broad contact with both (i) horizontal leg 23 of the bar 21 (on one side of the leg 24) and (ii) horizontal leg extension 37 of the horizontal leg 23 (on the other side of the leg 24) for the purpose of rigidly supporting and securing mount 22 relative to the status bar 21, viz., aiding in the prevention of the mount 22 from toppling off the upright leg 24 in a direction normal to arrow 49.

Figure 5:
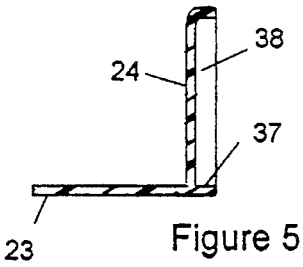
FIG. 5 is a section taken along line 5—5 of FIG. 4.

Note also from FIGS. 5 and 6 that in addition to the horizontal extension 37 of the horizontal leg 23 of the status bar 21, the vertical leg 24 is provided with a pair of side flap segments 38 at the ends of the status bar 21. The flap segments 38 are seen to be coextensive of the horizontal extension 37 so as maximize rigidity of the mount-status bar subassembly, viz. by the placement of the mount 22 more toward the centroid of the status bar 21 as shown in FIG. 6. In that way, stability of the mount 22 is achieved.

FIGS. 7 and 8 show an alternate mount 60 in detail.

The mount 60 includes clasp 61 and upright frame 62 of similar construction as previously described, viz., each defined by a U-shaped cross section and including connected end walls 63. But in addition, an exterior brace 64 has been added to the same side of the clasp 61 and upright frame 62. Such brace 64 is of rectangular cross section and includes broad inner surface 65 Such inner surface 65 is constructed to provide coplanar contact with side wall 67*a* of the frame 62 and with side wall 69*a* of the clasp 61. The remaining side walls 67*b*, 69*b* are thus more easily provided with cantilevered flexibility to accommodate attachment as hereinbefore described. In other words, the side wails 67*b*, 69*b* are constructed so that they are biased inwardly toward tear-drop shaped cavities 70, 71, respectively, wherein such cavities 70, 71 are largest adjacent to connected end wails 63 and smallest adjacent to terminal ends 72, 73, respectively.

FIGS. 9 and 10 show another alternate mount 80 in detail.

The mount 80 includes an upright frame 81 of similar construction as previously described, viz., of a U-shaped cross section having an end wall 82. A brace 83 is positioned at one side of the frame 81 and includes a cantilevered segment 84 that extends below the end wall 82. The purpose of the cantilevered segment 84: to provide broad surface 85 that can be attached by an adhesive to the upright leg 24 of the status bar 21 of FIG. 1. From the foregoing, it is evident that alternate mount 80 has allowed clasp 61 of FIGS. 7 and 8 can be omitted. Note that the brace 83 is of rectangular cross section and includes broad upper surface 86 in contact with frame 81 for further rigidizing purposes. That is, inner surface 86 of the brace 83 is constructed to provide coplanar contact with side wall 87*a* of the frame 81. The remaining side wall 87*b* of the frame 81 is thus more easily provided with cantilevered flexibility to accommodate the card 25 of FIG. 1 as hereinbefore described. In other words, the side wall 87*b* is constructed so that it is biased inwardly toward tear-drop shaped cavity 88 wherein such cavity 88 is largest adjacent to end wall 82 and smallest adjacent to terminal ends 89 of the side walls 87*a*, 87*b*.

FIGS. 11 and 12 show yet another alternate mount 90 in detail

The mount 90 includes an upright frame 91 of similar construction as previously described, viz., of a U-shaped cross section having an end wall 92. A brace 93 is positioned at one side of the frame 91 and includes a cantilevered segment 94 that outwardly stepped at step 95 to define a bulbous segment 96, such cantilevered segment 94 extending beyond the end wall 92. The purpose of the cantilevered segment 94: to provide broad surfaces 97*a*, 97*b* that can be attached by an adhesive to both the upright leg 24 and to the horizontal extension 37 of the horizontal leg 23 of the status bar 21 of FIG. 1. Again, mount 90 permits the clasp 61 of FIGS. 7 and 8 to be omitted but also in addition, allows the frame 91 to clear upper flap segment 39 of the status bar shown in FIG. 19, as explained below.

Note that the brace 93 is of rectangular cross section and includes broad upper surface 99 in contact with frame 91 for further rigidizing purposes. That is, inner surface 99 of the brace 93 is constructed to provide coplanar contact with side wall 100*a* of the frame 91. The remaining side wall 100*b* of the frame 91 is thus more easily provided with cantilevered flexibility to accommodate the card 25 of FIG. 1 as hereinbefore described. In other words, the side wall 100*b* is constructed so that it is biased inwardly toward tear-drop shaped cavity 101 wherein such cavity 101 is largest adjacent to end wall 92 and smallest adjacent to terminal ends 103 of the side wall 100*a*, 100*b*.

Figure 13:
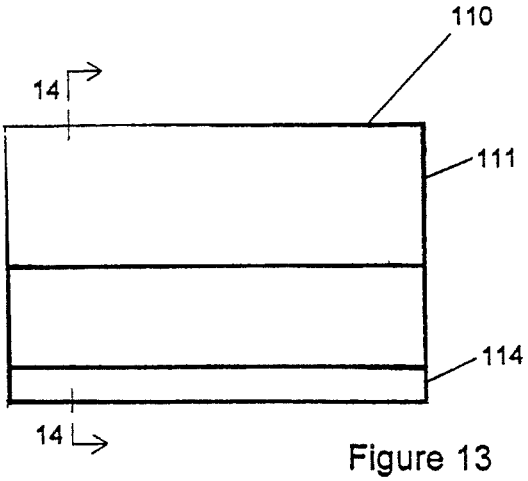
FIG. 13 is a front view of yet another alternate mount of the invention.
Figure 14:
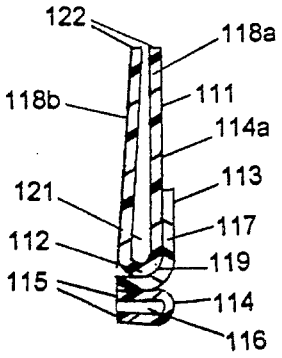
FIG. 14 is a section taken along line 14—14 of FIG. 13.

FIGS. 13 and 14 show yet another alternate mount 110 in detail.

The mount 110 includes an upright frame 111 of similar construction as previously described, viz., of a U-shaped cross section having an end wall 112. A compound curved brace 113 is positioned about the end wall 112 and a lower portion of side wall 114*a* and cantelevers therefrom to form a clip segment 114. The clip segment 114 is U-shaped in cross section and includes side walls 115 forming a cavity 116. The purpose of the clip segment 114: to attach to a horizontally extending element of the status bar 21 of FIG. 1 (instead of vertical leg 24), say to the upper flap segment 39 shown in FIG. 19 as explained below. In its upper region, the curved brace 113 is provided with an first curved surface 117 that can be attached to both the side wall 118*a* and to the end wall 112 of the frame 111. In the region below the end wall 112, the brace 113 is provided with an exterior surface 119 that is attached to one of the side walls 115 of the clip segment 114.

Note that the side wall 118*b* of the frame 111 is easily provided with cantilevered flexibility to accommodate the card 25 of FIG. 1 as hereinbefore described. In other words, the side wall 118*b* is constructed so that it is biased inwardly toward tear-drop shaped cavity 121 wherein such cavity 121 is largest adjacent to end wall 112 and smallest adjacent to terminal ends 122 of the side walls 118*a*, 118*b*.

FURTHER MODIFICATIONS

FIGS. 15–19 show modifications of the status bar of FIGS. 1, 4–6 .

Recall previously that the status bar 2l of FIGS. 1, 4–6 included a horizontal extension 37 coplanar with the horizontal leg 23 of FIG. 1 as well as side flap segments 38 coextensive of the horizontal extension 37 wherein the formed structure is closed along three sides but open along the fourth side to accept the mount 22 of the invention.

Figure 15:
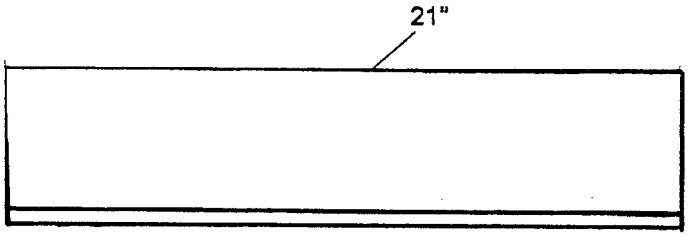
FIG. 15 is a front view of alternative status bar for use with the invention of FIGS. 1–3.
Figure 16:
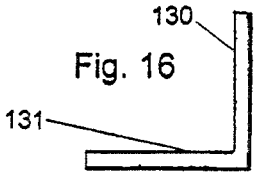
FIG. 16 is a side view of the status bar of FIG. 15.

In FIGS. 15 and 16, the status bar 21' is seen to be modified to omit the flap segments 37, 38 entirely, i.e., the vertical leg 130 and horizontal leg 131 are of similarly thicknesses, shape and dimensions.

Figure 17:
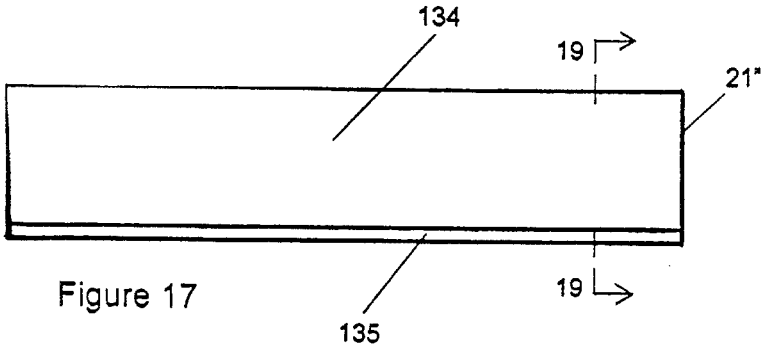
FIG. 17 is a front view of another status bar with use with the invention of FIGS. 1–3.
Figure 18:
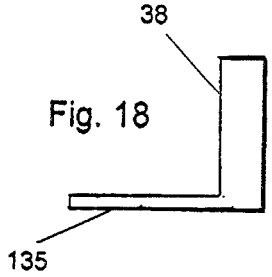
FIG. 18 is a side view of the status bar of FIG. 17.
Figure 19:
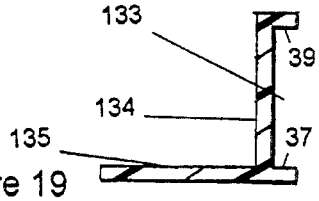
FIG. 19 is a section taken along line 19—19 of FIG. 17.

In FIGS. 17–19, the status bar 21" is seen to be modified to add upper flap segment 39 coextensive with the side flap segments 38 and the horizontal extension 37. That is, a cavity 133 has been formed at one side of the vertical leg 134, such cavity 133 being defined by the side flap segments 38, the upper flap segment 39 and and the horizontal extension 37 of the horizontal leg 135.

Further modifications and changes will be readily apparent to those skilled in the art and such apparent changes are to be included within the scope of the following claims.

What is claimed is:

1. A mount for use with a status bar used within a mail sorting tray, said sorting tray including a series of longitudinally slots normalized to a given geographical area or street region, each of said slots being associated with a given address within such geographical area or street region, said status bar comprising a transversely directed leg and a longitudinal directed leg and being color coded to indicate a change in status of at least one addressee associated with a given slot, said mount to be attached to said transversely directed leg of said bar and comprising a first U-shaped member having a pair of coextensive side walls and an end wall defining a tear-drop shaped cavity having a bulbous portion adjacent to said end wall and a declining apex remote from said common end wall, said declining apex being outwardly biasable to permit entry therethrough for the purpose of releasable attachment of at least a card having written indicia about an addressee thereon, said mount including a planar member having a first segment having a broad surface in contact with one of said side walls and a second segment intragally formed within and cantilevered with respect to said first segment, said second segment of said planar member including a stepped bulbous section for attachment to said transversely directed leg of said bar along at least two separate surfaces for rigidizing attachment therebetween.

2. A status bar subassembly for use within a mail sorting tray, said tray including series of longitudinally extending slots normalized to a given geographical area or street region, each of said slots being associated with a given address within such geographical area or street region, comprising a status bar comprising a transversely directed leg and a longitudinally directed leg and being color coded to indicate a change in status of at least one addressee associated with a given slot, a mount attached to said transversely directed leg of said status bar and comprising a first U-shaped member having a pair of coextensive side walls and an end wall defining a tear-drop shaped cavity having a bulbous portion adjacent to said end wall and a declining apex remote from said common end wall, said declining apex being outwardly biasable to permit entry therethrough for the purpose of releasable attachment of at least a card having written indicia about an addressee thereon.

3. The status bar subassembly of claim 2 wherein said mount includes a second U-shaped member stacked transversely below said first mount having an end wall common with said end wall of said first U-shaped member and a pair of side wails extending from said common end wall to define a tear-drop shaped cavity having a bulbous portion adjacent to said end wall and a declining apex remote from said common end wall, said declining apex being outwardly biasable to permit entry therethrough for the purpose of releasable attachment of at least said transversely directed leg of said status bar for releasably attaching said mount relative to said status bar.

4. The status bar subassembly of claim 2 wherein said mount includes a planar member having a first segment having a broad surface in contact with one of said side walls and a second segment intragally and cantilevered with respect to said first segment and attached to said transversely directed leg of said status bar for attaching said mount relative to said status bar.

5. The status bar subassembly of claim 4 wherein said second segment of said planar member includes a stepped bulbous section for attachment to said transversely directed leg of said status bar along at least two separate surfaces for rigid attachment of said mount relative to said status bar.

6. For use in efficiently sorting mail associated with a given address with a geographical area or street region, the combination comprising a mail sorting tray including a series of longitudinally extending slots normalized to a given geographical area or street region, each of said slots being associated with a given address within such geographical area or street region, a status bar comprising a transversely directed leg and a longitudinally directed leg and being color coded to indicate a change in status of at least one addressee associated with a given slot, a mount attached to said transversely directed leg of said status bar and comprising a first U-shaped member having a pair of coextensive side walls and an end wall defining a tear-drop shaped cavity having a bulbous portion adjacent to said end wall and a declining apex remote from said common end wall, said declining apex being outwardly biasable to permit entry therethrough for the purpose of releasable attachment of at least a card having written indicia about an addressee thereon.

7. The combination of claim 6 wherein said mount includes a second U-shaped member stacked transversely below said first mount having an end wall common with said end wall of said first U-shaped member and a pair of side walls extending from said common end wall to define a tear-drop shaped cavity having a bulbous portion adjacent to said end wall and a declining apex remote from said common end wall, said declining apex being outwardly biasable to permit entry therethrough for the purpose of releasable attachment of at least said transversely directed leg of said status bar for releasably attaching said mount relative to said status bar.

8. The combination of claim 6 wherein said mount includes a planar member having a first segment having a broad surface in contact with one of said side walls and a second segment intragally and cantilevered with respect to said first segment and attached to said transversely directed leg of said status bar for attaching said mount relative to said status bar.

9. The combination of claim 8 wherein said second segment of said planar member includes a stepped bulbous section for attachment to said transversely directed leg of said status bar along at least two separate surfaces for rigid attachment of said mount relative to said status bar.

* * * * *